US012123266B2

(12) United States Patent
Coyle, Jr.

(10) Patent No.: US 12,123,266 B2
(45) Date of Patent: Oct. 22, 2024

(54) TAPERED BOWL WITH MOVABLE SECTION

(71) Applicant: Bilco Tools, Inc., Houma, LA (US)

(72) Inventor: William E. Coyle, Jr., Houma, LA (US)

(73) Assignee: BILCO TOOLS, INC., Houma, LA (US)

( * ) Notice: Subject to any disclaimer, the term of this patent is extended or adjusted under 35 U.S.C. 154(b) by 0 days.

(21) Appl. No.: 18/387,026

(22) Filed: Nov. 4, 2023

(65) Prior Publication Data

US 2024/0159114 A1 May 16, 2024

Related U.S. Application Data

(60) Provisional application No. 63/424,774, filed on Nov. 11, 2022.

(51) Int. Cl.
*E21B 19/10* (2006.01)

(52) U.S. Cl.
CPC ..... *E21B 19/10* (2013.01)

(58) Field of Classification Search
CPC ..... E21B 19/10
See application file for complete search history.

(56) References Cited

U.S. PATENT DOCUMENTS 4,354,706 A * 10/1982 Coyle, Sr. ..... E21B 19/07 294/90
4,381,584 A * 5/1983 Coyle, Sr. ..... E21B 33/047 294/102.2
5,335,756 A * 8/1994 Penisson ..... E21B 19/10 188/67
7,703,540 B2 * 4/2010 Webre ..... E21B 19/10 166/77.1
9,422,778 B2 * 8/2016 Angelle ..... E21B 19/07

* cited by examiner

*Primary Examiner* — Aaron L Lembo
(74) *Attorney, Agent, or Firm* — Patrick K. Steele

(57) ABSTRACT

A tapered bowl assembly having a tapered bowl main portion with a tapered bore and a radially outwardly extending gap in the tapered bore, a tapered bowl movable portion securable within the gap and removable from the gap, a set of slips sized and shaped for introduction intermediate the tapered bore of the tapered bowl main portion to grip and support a tubular string introduced through the tapered bore, the tapered bowl movable portion being releasable from the secured position within the gap to a released position to allow the tubular string to be released from support by the tapered bowl assembly.

10 Claims, 10 Drawing Sheets

FIG. 2
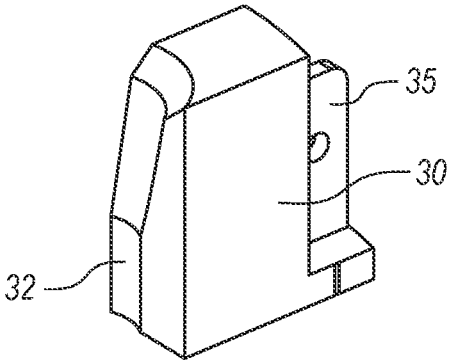
FIG. 3
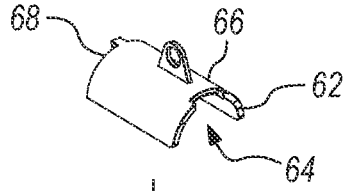
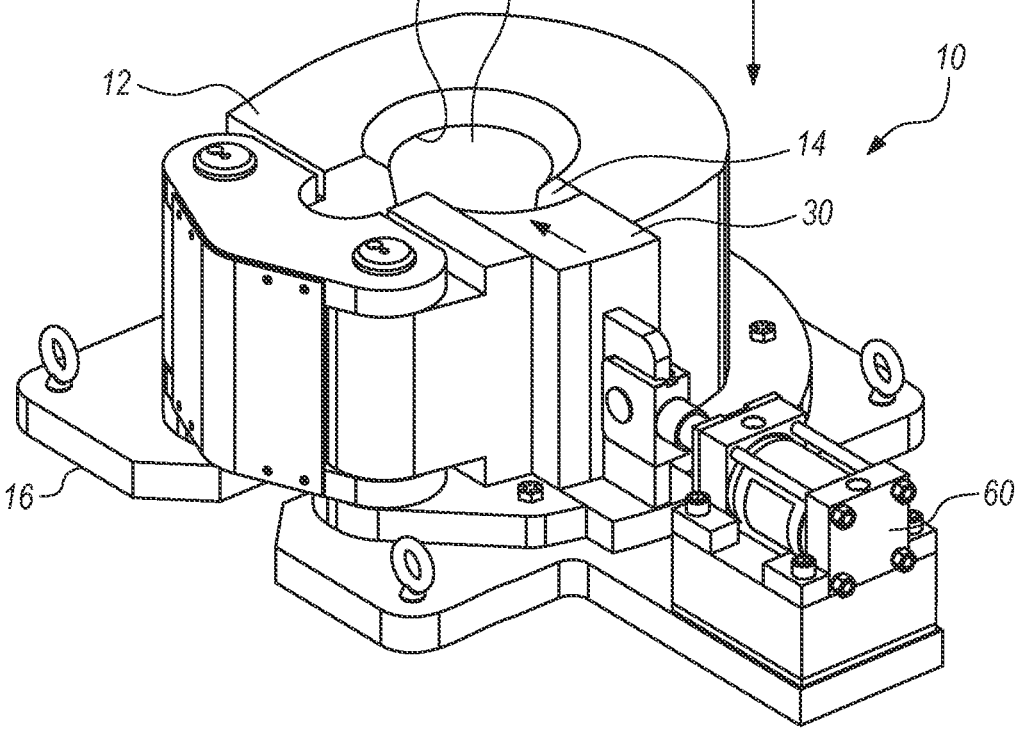
FIG. 1

TAPERED BOWL WITH MOVABLE SECTION

BACKGROUND

Statement of Related Applications

This application depends from and claims priority to U.S. Provisional Application No. 63/424,774 entitled Tapered Bowl with Movable Portion filed on Nov. 11, 2022.

FIELD OF THE INVENTION

The present invention relates to tools used on a drilling rig to support a tubular string in a borehole drilled into the Earth's crust. More specifically, the present invention relates to a tapered bowl assembly that cooperates with a set of slips to engage and support a tubular string within a drilled borehole.

BACKGROUND OF THE RELATED ART

Tapered bowl assemblies with cooperating slips introduced into the tapered bowl to receive and support tubular strings introduced through an aperture in the tapered bowl are widely used in the oil and gas industry. These tools offer a reliable means of gripping and supporting a tubular string as a tubular joint or a stand of tubular joints are threadedly coupled to the exposed upper end of the tubular string. The extended tubular string is then lifted using an elevator supported from an overhead draw works to unload the tapered bowl and the set of slips, and the slips are dislodged to allow the tubular string to be lowered further into a drilled borehole in the earth's crust. Afterwards, the slips are re-engaged with the tubular string to again support the tubular string from the tapered bowl assembly, and the cycle can be repeated.

Operators of drilling rigs may use blow-out preventers, or BOPs, to close off the drilled borehole in the event of a well control situation. A BOP may be rams, which engage and collapse the tubular string upon activation of the rams to close the borehole. These tools may sever the tool string at the point of engagement, thereby releasing the portion of the tubular string below the BOP. Another type of BOP is an annular BOP which includes curved faces to engage the tubular string from opposing sides to create a seal to isolate the annulus formed between the tubular string and the casing installed to stabilize the drilled borehole. In marine drilling operations, BOPs may be disposed on the sea floor and activated to engage and collapse the tubular string at a distance below the rig approximately equal to the depth of the water.

In some circumstances, a pipe joint or tubular joint comprising the upper end of one pipe segment of the tubular string and a threadedly coupled lower end of an adjacent pipe segment of the tubular string may be positioned within the BOP, thereby disposing a portion of the tubular string that is substantially resistant to collapse intermediate the opposed rams of the BOP. This situation can result in a lack of well stability and an unwanted well control situation if the forces applied to the pipe joint of the tubular string captured intermediate the rams are insufficient to fully collapse or part the tubular string.

In some circumstances, it may be advantageous to release a tubular string from the rig and to allow the tubular string to drop within a drilled borehole in order to prevent obstruction of rams that may be disposed, for example, on a drilling rig or, in marine drilling operations, on the sea floor. For example, but not by way of limitation, a marine drilling rig may be used to drill an earthen borehole in a water depth of 3,000 feet (914 meters). A set of rams may be coupled to the rig for use in maintaining well control, and a set of rams may be disposed on the sea floor. If the well is drilled to a depth of 4,000 feet (1,219 meters) below the sea floor, and if the length of a pipe string supported in an embodiment of the tapered bowl assembly of the present invention on the rig is, for example, but not by way of limitation, 3,600 feet (1,097 meters), then releasing the tubular string during a well control situation would allow the entire tubular string to fall into the borehole beneath the rams on the sea floor, thereby allowing the rams on the sea floor to be closed without obstruction to contain the well. As another example, but not by way of limitation, if the water depth is 3,000 feet (914 meters) and the length of the tubular string supported by an embodiment of the tapered bowl assembly of the present invention exceeds the length of the borehole beneath the sea floor rams, the tubular string can be released from the rig to allow the tubular string to descend beneath the rams that are on the rig. This allows the rams on the rig to be closed without concern for a tubular joint obstructing closure and sealing of the rams. The latter example might result in the pressurization of the riser intermediate the sea floor rams and the rig if the obstruction of the sea floor rams by the tubular string prevents full closure of the well at the sea floor rams.

BRIEF SUMMARY

One embodiment of the tapered bowl assembly of the present invention provides a tapered bowl assembly for engaging and supporting a tubular string within a drilled borehole comprising at least one tapered bowl main portion that has a gap extending radially outwardly from the center bore that penetrates the center of the tapered bowl. The tapered bowl assembly further comprises at least one tapered bowl movable portion that is sized and shaped to be removably received into the gap in at least one tapered bowl main portion, and at least one retainer assembly that engages and releasably secures at least one tapered bowl movable portion in a secured position within the gap in the at least one tapered bowl main portion. In this position, a slip-engaging face of the at least one tapered bowl movable portion is flush with the interior surface of the tapered bore of at least one tapered bowl main portion to provide a fully circumferential tapered bore to receive a tubular string and a set of slips introduced intermediate the interior surface of the fully circumferential tapered bore and the tubular string.

It will be understood that embodiments of the tapered bowl assembly of the present invention can be used to engage and releasably support one tubular string or two tubular strings. Two tubular strings may be present with dual completion boreholes having two side-by-side tubular strings. Generally, for dual completion boreholes, a first tubular string may be completed to produce a first geologic formation or a first set of geologic formations at a first depth range in the borehole and a second tubular string may be used to produce a second geologic formation or a second set of geologic formations at a second depth range in the borehole that is fluidically isolated from the first geologic formation or set of geologic formations. An embodiment of a tapered bowl assembly of the present invention adapted for dual completion boreholes may provide the capacity to support the two tubular strings within the borehole with the surface ends of the tubular strings in a closely adjacent configuration or in a spaced-apart configuration, which may be needed to facilitate the use of a power tong to engage and make-up a threaded connection as necessary to join additional joints of tubulars or additional stands of tubulars.

BRIEF DESCRIPTION OF THE SEVERAL VIEWS OF THE DRAWINGS

FIG. 1 is a perspective view of an embodiment of a tapered bowl assembly of the present invention including a tapered bowl main portion with a radially outwardly extending gap therein, a tapered bowl movable portion that is receivable into the gap of the tapered bowl main portion and securable within the gap by a retainer assembly (shown in FIG. 1 in a released position) to provide a fully circumferential tapered bore to receive and cooperate with a set of tubular gripping slips (not shown).

FIG. 2 is a perspective view of the tapered bowl movable portion of FIG. 1 after it has been removed from the gap.

FIG. 3 is a perspective view of a safety member of the retainer assembly of FIG. 1.

DETAILED DESCRIPTION

Figure 4:
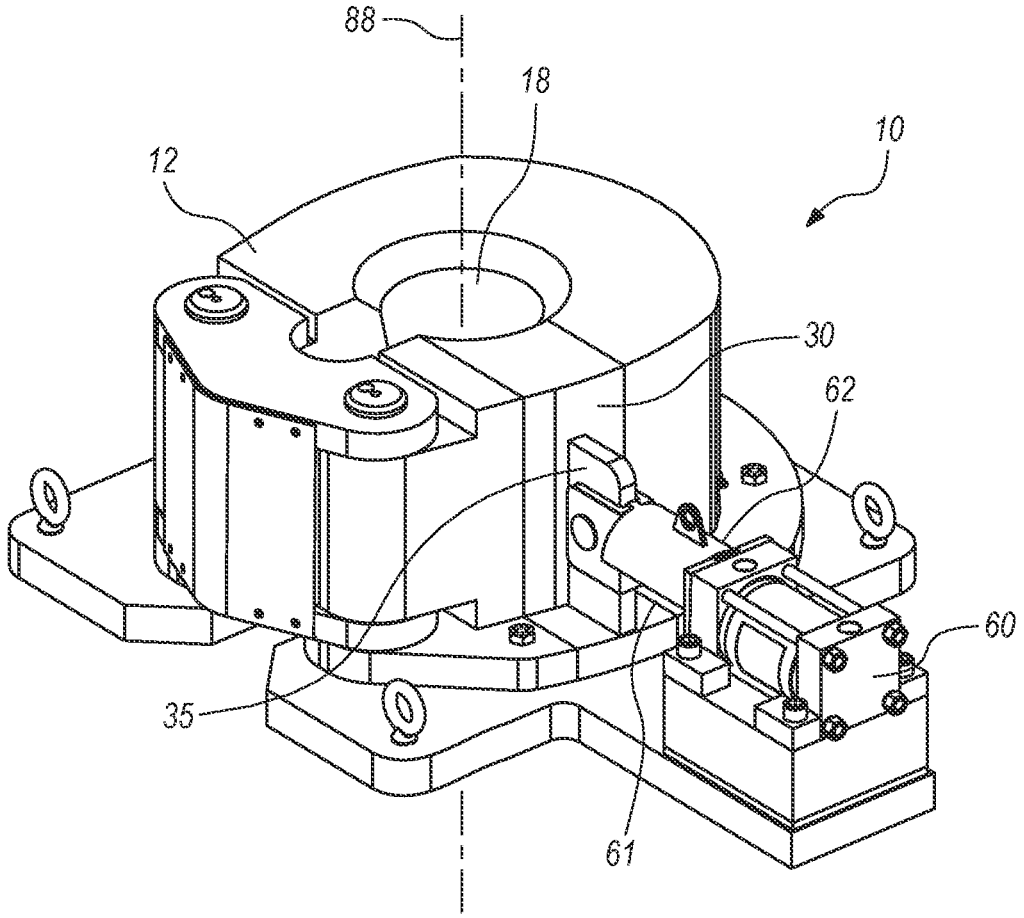
FIG. 4 is a perspective view of the tapered bowl assembly of FIG. 1 after the retainer assembly is activated to move the tapered bowl movable portion into the gap of the tapered bowl main portion to a secured position to provide a fully circumferential tapered bore that can receive and cooperate a set of slips to support a tubular string passing through the tapered bore.

FIG. 1 is a perspective view of an embodiment of a tapered bowl assembly 10 of the present invention including a tapered bowl main portion 12, the tapered bowl main portion 12 being supported on a base plate 16 that is securable to a rig floor (not shown), the tapered bowl main portion 12 including an angular gap 14 extending radially outwardly from a tapered bore 18 that has an interior surface 20 that has shape of an inverted frustum of a cone, except for the missing portion forming the gap 14. The tapered bowl assembly 10 of FIG. 1 further includes a tapered bowl movable portion 30 that is receivable into the gap 14 of the tapered bowl main portion 12, the tapered bowl movable portion 30 being movable between a retracted position (shown in FIG. 1) and a secured position (shown in FIG. 2). The tapered bowl movable portion 30 is securable within the gap 14 by activation of the retainer assembly 60 to move the tapered bowl movable portion 60 from the retracted position shown in FIG. 1 to the secured position shown in FIG. 2 to provide a fully circumferential tapered bore that is shaped and sized to receive and cooperate with a set of tubular string gripping slips (not shown in FIG. 1) that may be received within the fully circumferential tapered bowl 18.

FIG. 2 is a perspective view of the tapered bowl movable portion 30 of FIG. 1 showing the face 32 of the tapered bowl movable portion 30. The face 32, when the tapered bowl movable portion 30 is moved from the retracted position shown in FIG. 1 to the secured position within the gap 14 of the tapered bowl main portion 12 as shown in FIG. 2, has the same curvature as the interior surface 20 of the tapered bore 18 of the tapered bowl main portion 12 (see FIG. 1) to provide a fully circumferential tapered bore 18 within the tapered bowl assembly 10 that can receive and cooperate with a set of slips (not shown) to grip and support a tubular string (not shown). Optionally, the tapered bowl movable portion 30 includes a bevel 31 intermediate a top 33 of the tapered bowl movable portion 30. The tapered bowl movable portion 30 may include a lug 35 for coupling the tapered bowl movable portion 30 to the retainer assembly 60 (shown in FIG. 1.

FIG. 3 is a perspective view of a safety member 62 for use with the retainer assembly 60 of FIG. 1. The safety member 62 includes a first end 66, a second end 68 and an interior cavity 64 therein.

FIG. 4 is a perspective view of the tapered bowl assembly 10 of FIG. 1 after the retainer assembly 60 is activated to move the tapered bowl movable portion 30 into the secured position within the gap 14 of the tapered bowl main portion 12 to provide a fully circumferential tapered bore 18 surrounding an axis 88. The tapered bore 18 of the tapered bowl assembly 10 can receive and cooperate a set of slips to support a tubular string (not shown) passing along the axis 88 and through the tapered bore 18. The safety member 62 is shown after being installed on a rod 61 that connects to the lug 35 of the tapered bowl movable portion 30 and extends outwardly from the retainer assembly 60 upon activation of the retainer assembly 60. The rod 61 is received into the interior cavity 64 (shown in FIG. 3) of the safety member 62 to prevent inadvertent release of the tapered bowl movable portion 30 from the secured position. In the configuration shown in FIG. 4, the tapered bore 18 of the tapered bowl assembly 10 can receive a set of cooperating slips to engage and support a tubular string.

Figure 5:
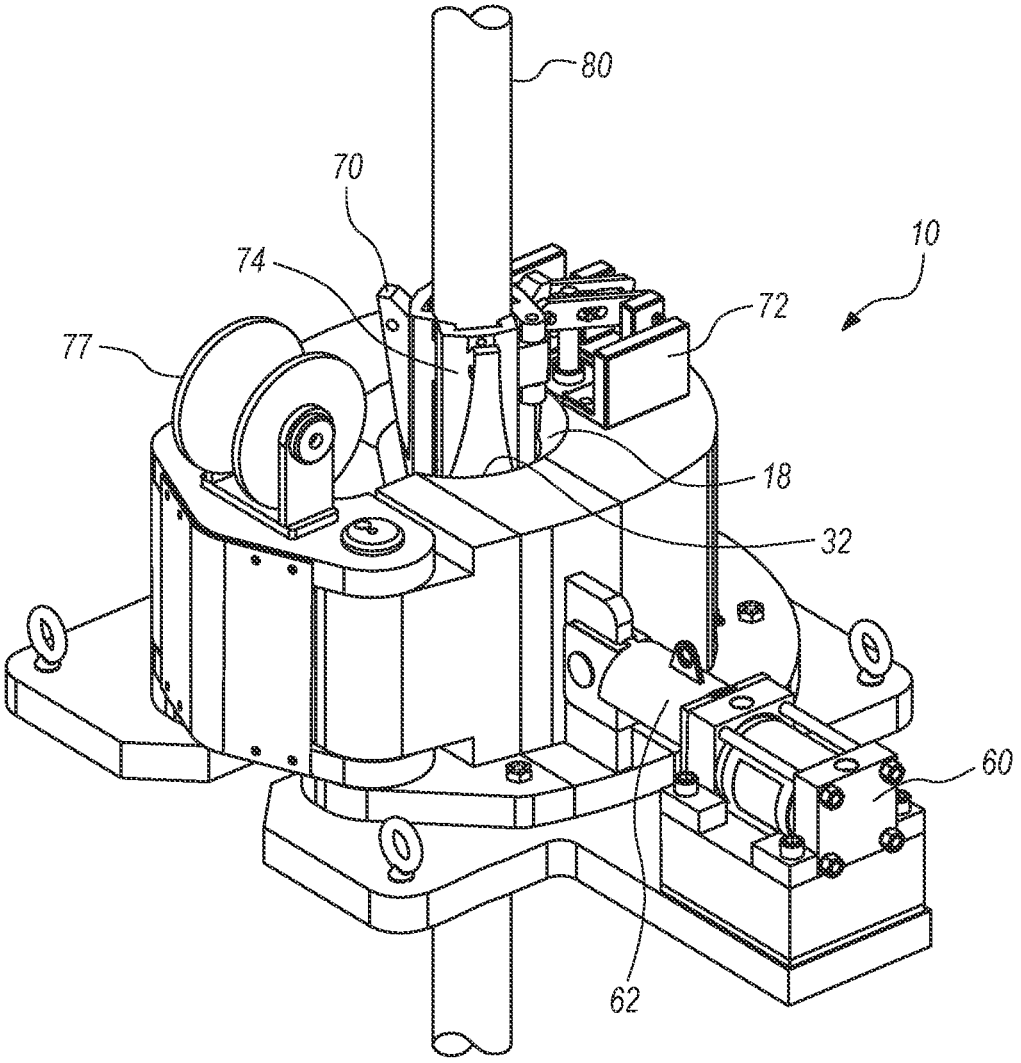
FIG. 5 is a perspective view of the tapered bowl assembly of FIG. 2 after a tubular string is introduced through the tapered bore and a set of slips are received intermediate the tapered bore of the tapered bowl assembly and the tubular string to grip and support the tubular string within the tapered bore.

FIG. 5 is a perspective view of the tapered bowl assembly 10 of FIG. 4 after a tubular string 80 is introduced through the tapered bore 18 of the tapered bowl assembly 10 and a set 70 of slips 74 are received intermediate the tapered bore 18 and the tubular string 80 to grip and support the tubular string 80 within the tapered bore 18. As the term is used herein, a "set" 70 of slips 74 may include three or more slips 74 coupled together. The set 70 of slips 74 are received intermediate the tubular string 80 and the tapered bore 18 to provide a self-tightening grip on the supported tubular string 80, as is known in the art. A slip actuator assembly 72 may be provided and controlled to move the set of slips 70 to engage and grip the tubular string 80 and to later disengage the set 70 of slips 74 from the tubular string 80. An optional roller 77 may be coupled to the tapered bowl main portion 12 to position a control line (not shown) that may be introduced into the borehole (not shown) along with the tubular string 80. Slip 74 of the set 70 of slips 74 shown in FIG. 5 is shown disposed intermediate the tubular string 80 and the face 32 of the tapered bowl movable portion 30 which, as shown in FIG. 5, is in the secured position. The tapered bowl movable portion 30 is maintained in the secured position by the retainer assembly 60 and the safety member 62 thereon.

Figure 6:
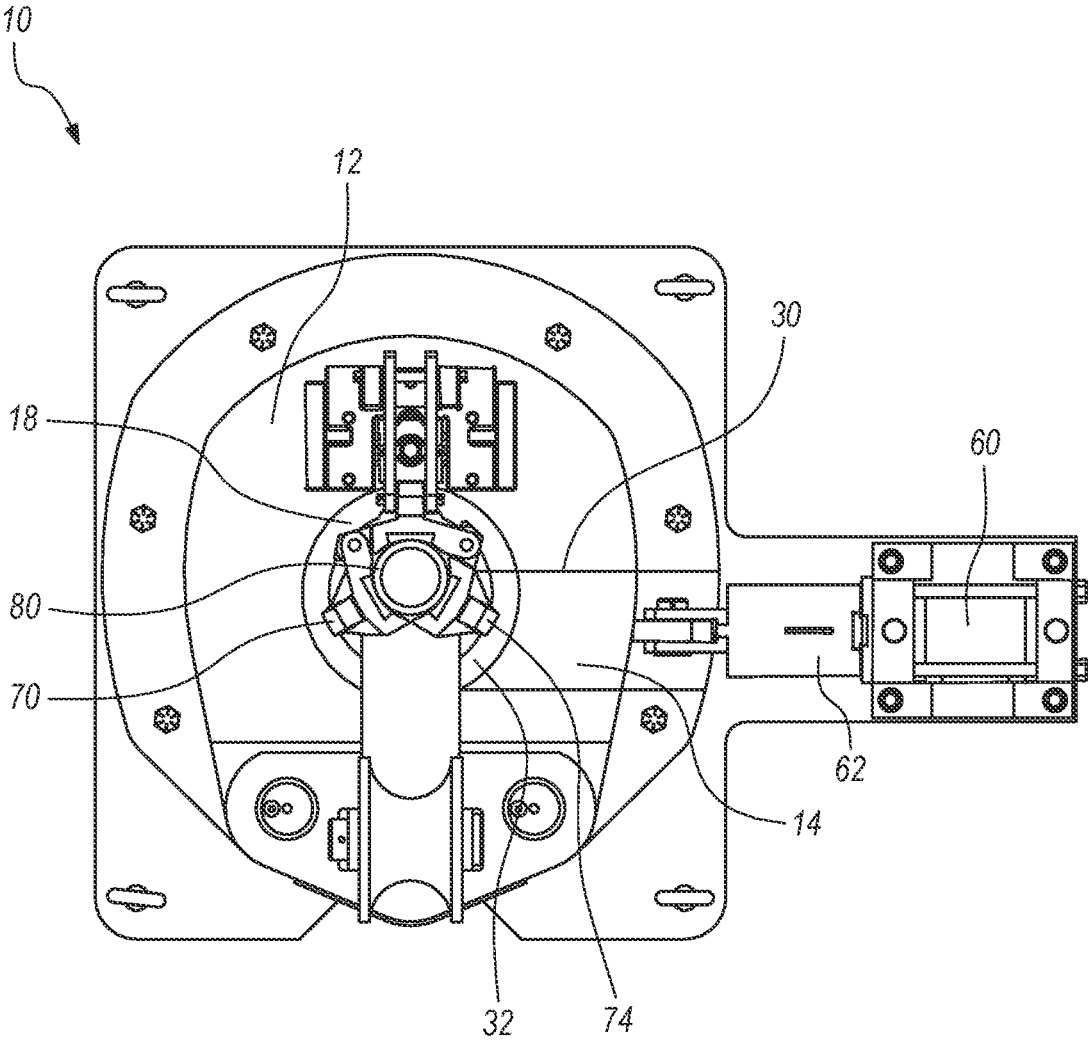
FIG. 6 is a plan view of the tapered bowl assembly, tubular string and slips of FIGS. 4 and 5.

FIG. 6 is a plan view of the tapered bowl assembly 10, the tubular string 80 and the set 70 of slips 74 of FIG. 5. FIG. 6 shows the tubular string 80 engaged by the set 70 of slips 74 that are disposed intermediate the tubular string 80 and the tapered bore 18 of the tapered bowl assembly 10. The retainer assembly 60 is shown in the engaged mode with the tapered bowl movable portion 30 in the secured position within the gap 14 of the tapered bowl main portion 12. A slip 74 of the set 70 of slips 74 is shown intermediate the face 32 of the tapered bowl movable portion 30 and the tubular string 80. The retainer assembly 60 is secured in the engaged mode shown in FIG. 6 by the safety member 62.

Figure 7:
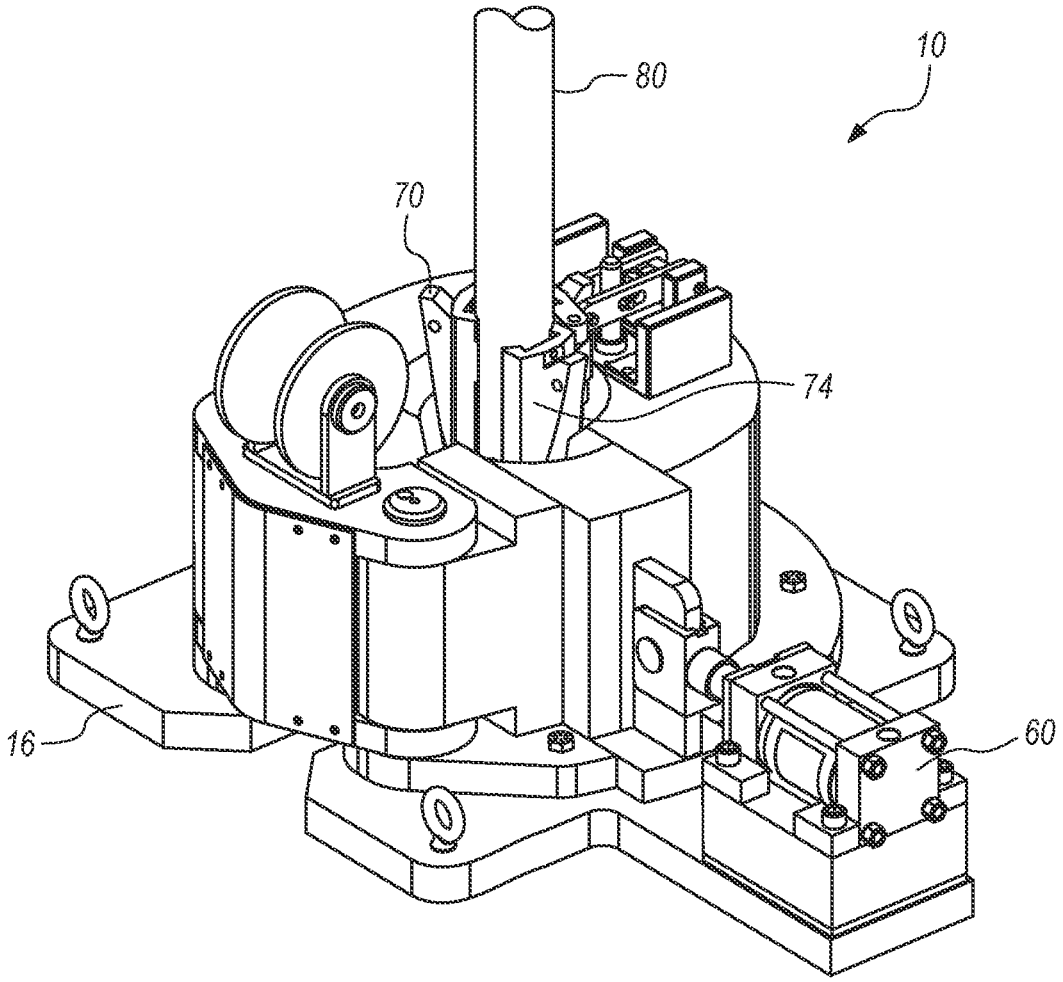
FIG. 7 is a perspective view of the tapered bowl assembly of FIG. 4 after the retainer assembly is released to allow movement of the tapered bowl movable portion radially outwardly and away from the set of slips, thereby allowing at least one of the slips of the set of slips to move away from positive engagement with the tubular string thereby resulting in the tubular string being released from the tapered bowl assembly.

FIG. 7 is a perspective view of the tapered bowl assembly 10 of FIGS. 5 and 6 after the safety member 62 is removed from the retainer assembly 60 and the retainer assembly 60 is deactivated to allow movement of the tapered bowl movable portion 30 radially outwardly and away from the secured position shown in FIG. 6, that is, away from the tubular string 80 and the set 70 of slips 74. This allows a slip 74 of the set 70 of slips 74 to pivot and move away from the secured position shown in FIGS. 5 and 6 and away from positive engagement with the tubular string 80, thereby resulting in the tubular string 80 being released from the tapered bowl assembly 10 and allowed to descend into the borehole (not shown) beneath the plate 16 and beneath the rig floor (not shown) that supports the plate 16 of the tapered bowl assembly 10.

Figure 8:
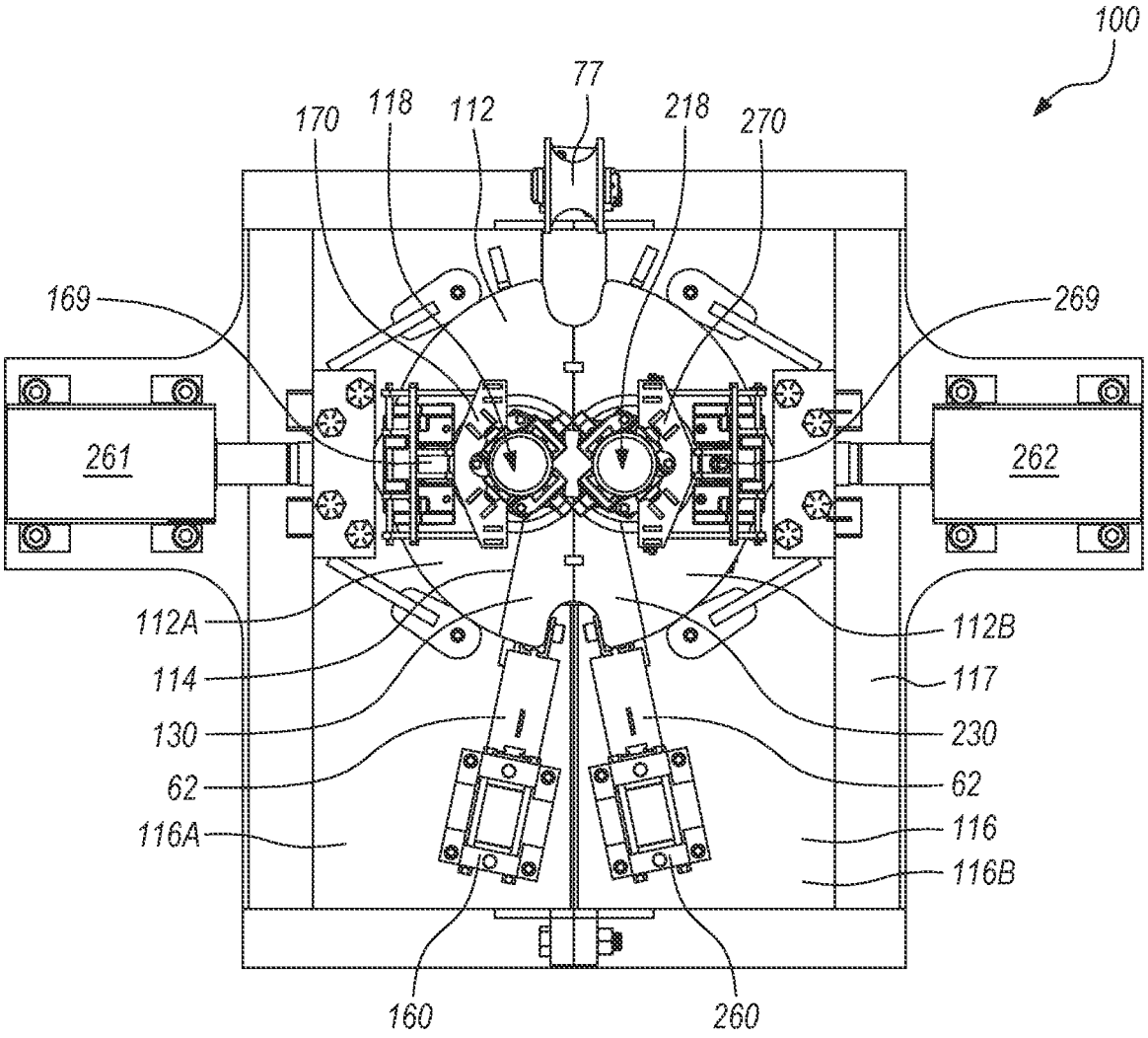
FIG. 8 is a plan view of an embodiment of the tapered bowl assembly of the present invention adapted for simultaneously receiving and releasably supporting two tubular strings.

FIG. 8 is a plan view of an embodiment of the tapered bowl assembly 100 of the present invention adapted for receiving and releasably supporting two tubular strings 180 and 280. The tapered bowl assembly 100 of FIG. 8 includes a bifurcated tapered bowl main portion 112 that comprises a first tapered bowl main portion 112A and a second tapered bowl main portion 112B that, when secured in the adjacent configuration shown in FIG. 8 by the first main retainer assembly 261 and the second main retainer assembly 262, respectively, together form a tapered bowl main portion 112 having an expandable gap 114. With the first tapered bowl main portion 112A and the second tapered bowl main portion 112B secured in the adjacent configuration shown in FIG. 8, the gap 114 formed in the tapered bowl main portion 112 is shaped and adapted to receive a first tapered bowl movable portion 130 and an adjacent second tapered bowl movable portion 230 that are secured in the gap 114 by a first retainer assembly 160 and a second retainer assembly 260, respectively. The tapered bowl assembly 100 of FIG. 8 includes a first tapered bore 118 and a second tapered bore 218. Received within the first tapered bore 118 of the tapered bowl assembly 100 of FIG. 8 is a first set 170 of slips 74 and received within the second tapered bore 218 of the tapered bowl assembly 100 of FIG. 8 is a second set 270 of slips 74. The first set 170 of slips 74 is coupled to a first slip operator 169 that moves the first set 170 of slips 74 between a seated position (shown in FIG. 8) and a retracted position and the second set 270 of slips 74 is coupled to a second slip operator 269 that moves the second set 270 of slips 74 between a seated position (shown in FIG. 8) and a retracted position. The components of the tapered bowl assembly 100 of FIG. 8 are shown supported on a bifurcated sliding plate 116 that includes a sliding plate first portion 116A supporting the first tapered bowl main portion 112A and the first tapered bowl movable portion 130 and a sliding plate second portion 116B supporting the second tapered bowl main portion 112B and the second tapered bowl movable portion 230. The sliding plate first portion 116A and the sliding plate second portion 116B are each slidably movable on a supporting plate 117 one away from the other, as will be shown in FIG. 13. A safety member 62 is shown as being received onto the first retainer assembly 160 and a safety member 62 is shown as being received onto the second retainer assembly 260 to secure the first tapered bore movable portion 130 in the secured position and the second tapered bore movable portion 260 in the secured position, respectively.

Figure 9:
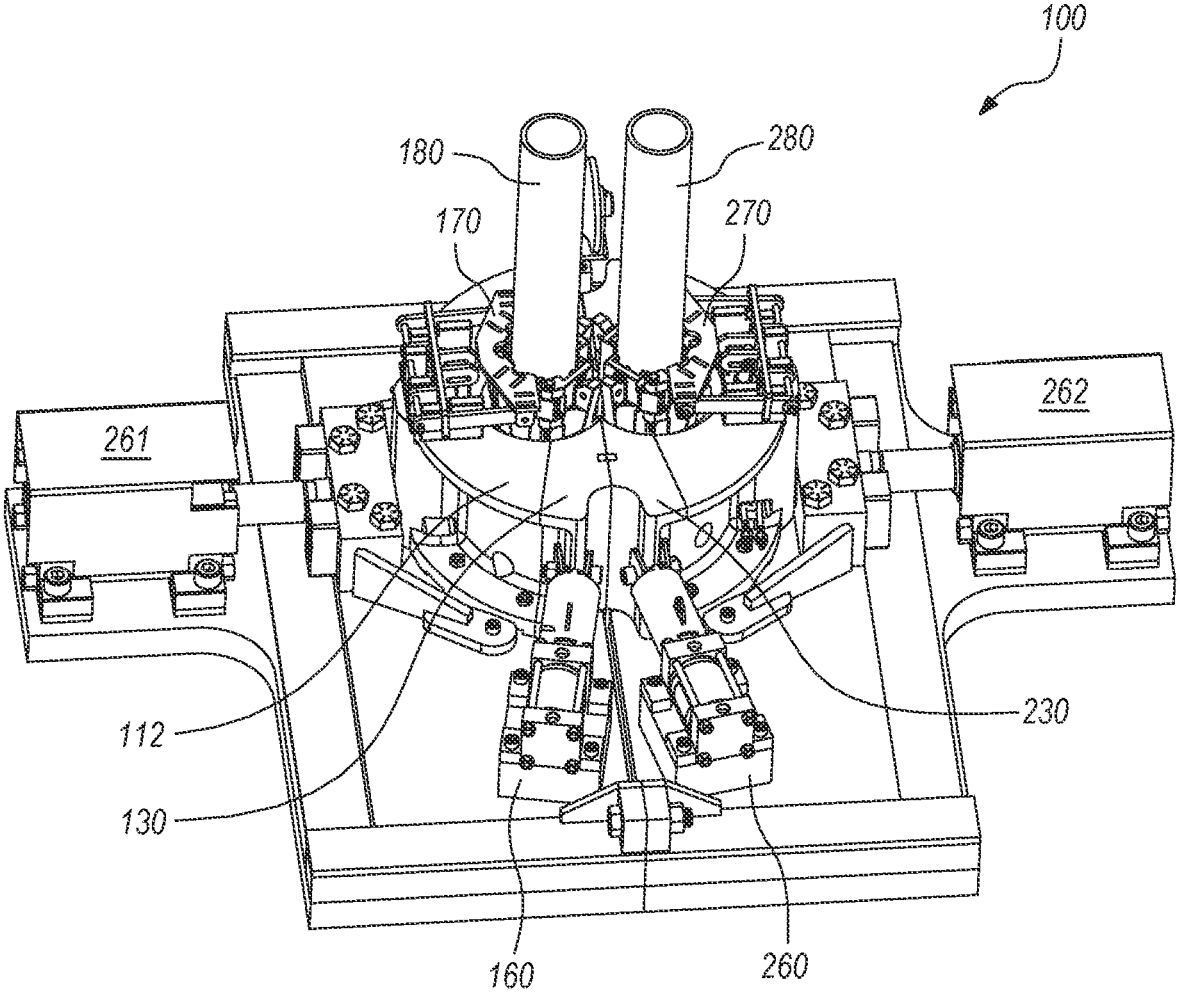
FIG. 9 is a perspective view of the tapered bowl assembly of FIG. 8.

FIG. 9 is a perspective view of the tapered bowl assembly 100 of FIG. 8 showing the first tubular string 180 received through the first tapered bore 118 (shown in FIG. 8) and a second tubular string 280 received through the second tapered bore 218 (shown in FIG. 8) of the tapered bore main portion 112. The first tapered bowl main portion 112A and the second tapered bowl main portion 112B can be moved from the adjacent configuration shown in FIGS. 8 and 9 using the first main retainer assembly 261 and the second main retainer assembly 262, respectively.

Figure 10:
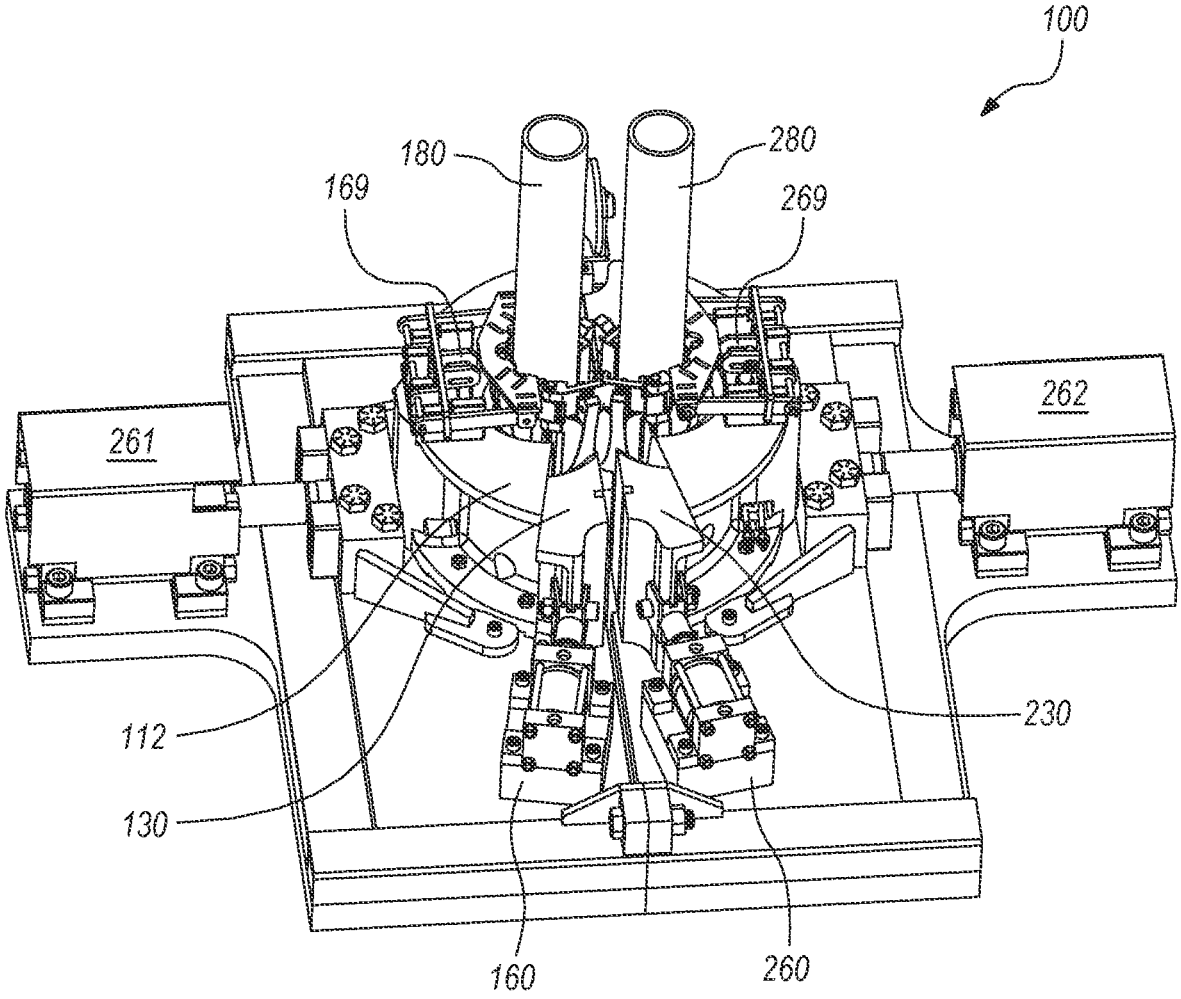
FIG. 10 is the perspective view of the tapered bowl assembly of FIG. 9 after the first and second retainer assemblies have been moved to the released position to move the connected first and second tapered bowl movable portions from the secured position to the released position.

FIG. 10 is the perspective view of the tapered bowl assembly of FIG. 9 after the safety members 62 are removed, and the first retainer assembly 261 and second retainer assembly 262 have been deactivated to the released position to move the connected first tapered bowl movable portion 130 and the second tapered bowl movable portion 230 from the secured positions shown in FIG. 9 to the released positions shown in FIG. 10. As with the embodiment of the tapered bowl assembly 10 illustrated in FIGS. 1-7, the movement of the first tapered bowl movable portion 130 and the second tapered bowl movable portion 230 from the secured positions shown in FIG. 9 to the released positions shown in FIG. 10 allows a slip 74 bearing there against to pivot away from each of the respective tubular strings 180 and 280 to release the tubular strings 180 and 280 and allow them to descend into the borehole (not shown) underneath the support plate 117. Optionally, as will be discussed further below and in connection with FIG. 13, first main retainer assembly 261 and second main retainer assembly 262 may be deactivated to move the first tapered bowl main portion 112A and the second tapered bowl main portion 112B one away from the other with the first tubular string 180 and the second tubular string 280 supported on the movable first tapered bowl main portion 112A and movable second tapered bowl main portion 112B, respectively.

Figure 11:
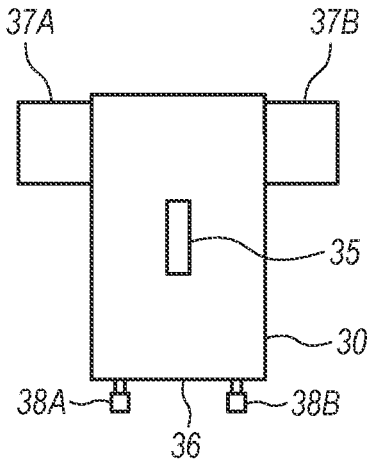
FIG. 11 is an elevation view of the tapered bowl movable portion of FIG. 2 after the addition of positioning members to prevent excessive movement of the tapered bowl movable portion into the gap and towards a center axis of the tapered bore of the tapered bowl main portion, and after the addition of rolling members to reduce frictional resistance to movement of the tapered bowl movable portion into and from the gap of the tapered bowl main portion.

FIG. 11 is an elevation view of the tapered bowl movable portion 30 of FIG. 2 after the addition of positioning members 37A and 37B to prevent excessive movement of the tapered bowl movable portion 30 into the gap 14 of the tapered bowl main portion 12 (not shown) and towards a center axis 88 of the tapered bore 18 of the tapered bowl main portion 12. The positioning members 37A and 37B extend laterally from the tapered bowl movable portion 30 and are positioned thereon at locations to engage the tapered bowl main portion 12 and thereby prevent further insertion of the tapered bowl movable portion 30 into the gap 14 of the tapered bowl main portion 12. Optionally, a tapered bowl movable portion 30 may have only one positioning member. Positioning member(s) may also be used to restrict positioning of the first tapered bowl movable portion 130 and the second tapered bowl movable portion 230 of the embodiment of the tapered bowl assembly 100 of FIG. 10.

The tapered bowl movable portion 30 shown in FIG. 11 also includes optional rolling elements 38A and 38B coupled to the bottom 36 of the tapered bowl movable portion 30 to provide low-friction movement of the tapered bowl movable portion 30 into and from the gap 14 of the tapered bowl main portion 12 (not shown). Various alternate structures such as wheels, rollers, bearings, tracks, etc. can also be used to reduce frictional resistance to movement of the tapered bowl movable portion 30 by the retainer assembly 60. Rolling elements 38A and 38B may also be coupled to each of the first tapered bowl movable portion 130 and the second tapered bowl movable portion 230 of FIG. 10 for the same purpose.

An embodiment of the tapered bowl assembly 100 may be disposed on a base plate 117 comprising a low-friction surface to enable ease of movement of the at least one tapered bowl movable portion into and out of the gap within the at least one tapered bowl main portion. The base plate 117 may comprise, in one embodiment, an ultra-high molecular weight polyethylene (UHMW), such as that available from Curbell Plastics, Inc. of Orchard Park, New York, USA, that is resistant to chemical attack and resistant to abrasion due to favorable wear resistance.

The retainer assembly 60 of FIG. 1 may, in one embodiment of the tapered bowl assembly 10 of the present invention, be hydraulically powered. A motor may be used to power a pump to provide pressurized hydraulic fluid to the retainer assembly 60, and upon activation, the retainer assembly 60 extends a pushrod that is coupled to a lug 39 (see FIG. 11) connected to the tapered bowl movable portion 30 for coupling the tapered bowl movable portion 30 to the retainer assembly 60. Alternately, the retainer assembly 60 can be pneumatically, mechanically or electrically powered.

Figure 12:
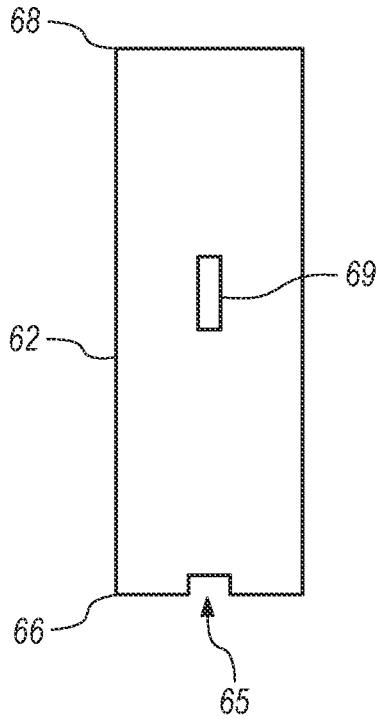
FIG. 12 is a plan view of the safety member of FIG. 3 after the addition of an indention at a first end of the safety member.

FIG. 12 is a plan view of the safety member 62 of FIG. 3 after the addition of an indention 65 at a first end 66 of the safety member 62. The indentation 65 is sized and positioned to enable the insertion of an end of a pry bar or other tool (not shown) that can be used to conveniently dislodge the safety member 62 from its installed and secured position shown in FIG. 4. For an added measure of safety, the indentation 65 may allow the tapered bowl movable portion 30 to remain in the secured position within the gap 14 of the tapered bowl main portion 12 (as shown in FIG. 4) notwithstanding depressurization of otherwise deactivation of the retainer assembly 60. Dislodging the safety member 62 would allow the force applied to the face 32 of the tapered bowl movable portion 30 by one or more of the set of slips to displace the tapered bowl movable portion 30 radially outwardly away from the center axis 88 of the tapered bowl main portion 12.

Figure 13:
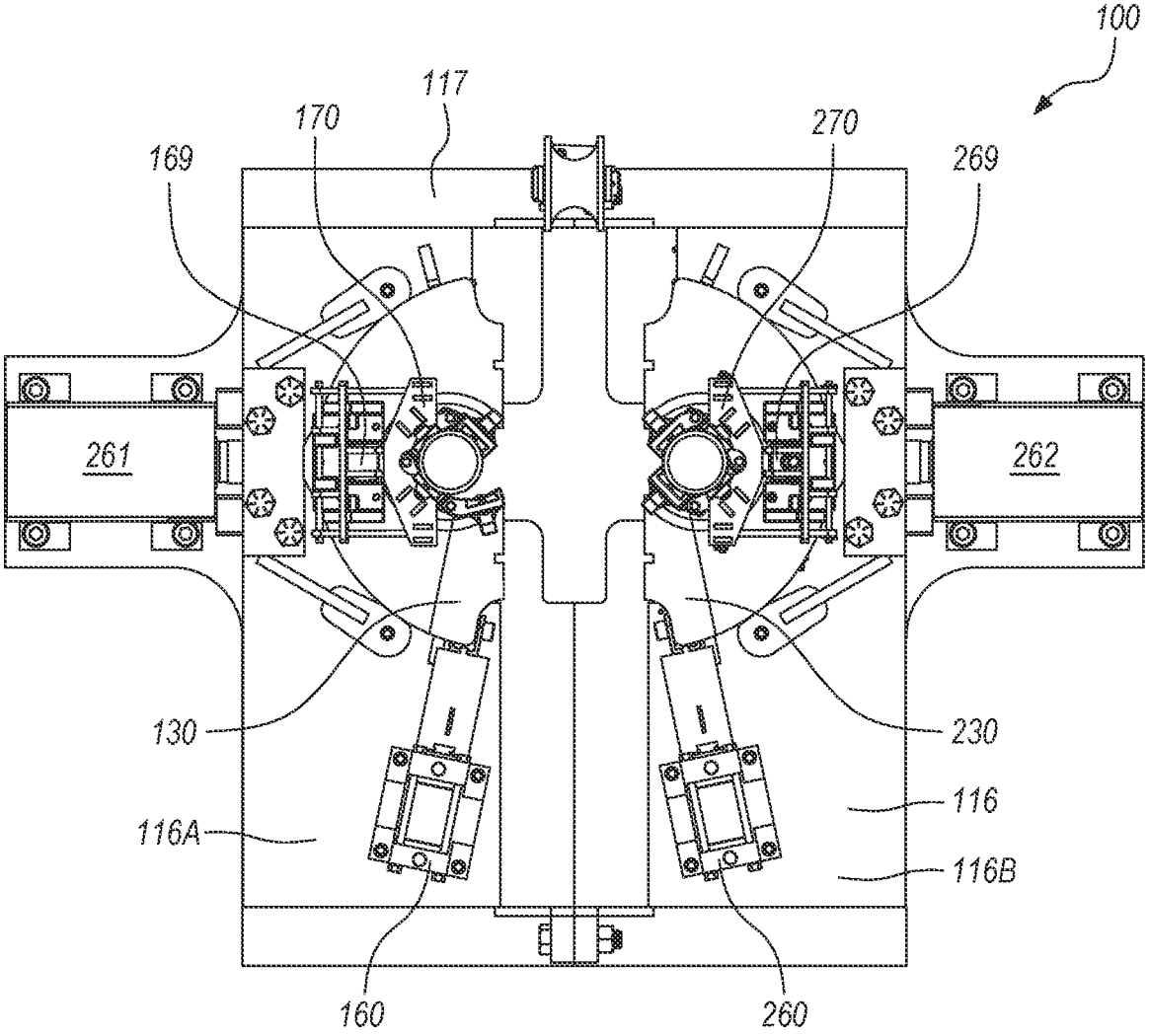
FIG. 13 is a plan view of the tapered bowl assembly of FIG. 8 after the first main retainer assembly and the second main retainer assembly are activated to move the first tapered bowl main portion and the second tapered bowl main portion, respectively, and to thereby separate the first tapered bowl main portion and the second tapered bowl main portion one from the other.

FIG. 13 is a plan view of the tapered bowl assembly 100 of FIG. 8 after the first main retainer assembly 261 and the second main retainer assembly 262 are activated to move the first tapered bowl main portion 112A and the second tapered bowl main portion 112B, respectively, and to thereby separate the first tapered bowl main portion 112A and the second tapered bowl main portion 112B one away from the other. FIG. 13 illustrates how the first main retainer assembly 261 is coupled to the sliding plate first portion 116A that supports the first tapered bowl main portion 112A and how the second main retainer assembly 262 is coupled to the sliding plate second portion 116B that supports the second tapered bowl main portion 112B. The base plate 117 remains stationary as the sliding plate first portion 116A, which is supported on the base plate 117, and the first tapered bowl main portion 112A that is supported on the sliding plate first portion 116A, are displaced towards the first main retainer assembly 261. The base plate 117 remains stationary as the sliding plate second portion 116B, which is supported on the base plate 117, and the second tapered bowl main portion 112B are displaced towards the second main retainer assembly 262. The first main retainer assembly 261 and the second main retainer assembly 262 may be powered using an electric motor or a mechanical linkage, or by pressurized fluid (pneumatic or hydraulic).

The first main retainer assembly 261 and the second main retainer assembly 262 of FIG. 13 may, in one embodiment of the tapered bowl assembly 100 of the present invention, be hydraulically powered. A motor may be used to power a pump to provide pressurized hydraulic fluid to each of the first main retainer assembly 261 and the second main retainer assembly 262, and upon activation, the first main retainer assembly 261 and the second main retainer assembly 262 each extend a pushrod that is coupled to the first tapered bowl movable portion 130 and the second tapered bowl movable portion 230, respectively. Alternately, the first main retainer assembly 261 and the second main retainer assembly 262 can be pneumatically, mechanically or electrically powered.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A tapered bowl assembly securable to a rig to releasably support a tubular string therefrom, the tapered bowl assembly comprising:

a tapered bowl main portion having a center axis, a top, a bottom and a tapered bore with a radially outwardly extending gap therein;

a tapered bowl movable portion having a top, a bottom, and a tapered bore face, the tapered bowl movable portion being positionable within the gap of the tapered bowl main portion in a secured position to close the gap and provide a fully circumferential tapered bore within the tapered bowl main portion, the tapered bowl movable portion being movable away from the center axis of the tapered bowl main portion to a released position;

a set of slips sized and shaped for introduction intermediate the tubular string and the tapered bore to grip and support the tubular string; and a retainer member having a secured mode to engage and to secure the tapered bowl movable portion in the secured position within the gap of the tapered bowl main portion and a released mode to release the tapered bowl movable portion to move from the secured position to the released position;

wherein release of the tapered bowl movable portion from the secured position and movement of the tapered bowl movable portion to the released position disengages the tubular string from the tapered bowl assembly; and wherein the movement of the retainer member from the secured mode to the released mode disables the set of slips from supporting the tubular string.

2. The tapered bowl assembly of claim 1, wherein the retainer member is movable from the released mode to the secured mode by a motive source.

3. The tapered bowl assembly of claim 2, wherein the motive source is one of a pneumatic cylinder, a hydraulic cylinder, an electric motor and a mechanically driven linkage.

4. The tapered bowl assembly of claim 1, wherein the tapered bowl movable portion includes a beveled edge intermediate the top and the face.

5. The tapered bowl assembly of claim 1, further comprising:

a safety member formed to engage the retainer member in a safety mode, the safety member being adapted for maintaining the retainer member in the secured mode until it is removed from the safety mode.

6. The tapered bowl assembly of claim 1, further comprising:

a slip actuator for moving the set of slips between an engaged position intermediate the tubular string and the tapered bore of the tapered bowl assembly and a retracted position with the slips removed from the position intermediate the tubular string and the tapered bore of the tapered bowl assembly.

7. A tapered bowl assembly, comprising:

a base plate supportable on a rig;

a first sliding plate movably supportable on the base plate between a closed position and an open position;

a second sliding plate movably supportable on the base plate between a closed position, adjacent to the first sliding plate in the closed position, and an open position, spaced apart from the first sliding plate in the open position;

a first tapered bowl main portion having a tapered bore therethrough and a radially outwardly extending gap in the bore, the first tapered bore main portion being supportable on and movable with the first sliding plate;

a second tapered bowl main portion having a tapered bore therethrough and a radially outwardly extending gap in the bore, the second tapered bore main portion being supportable on and movable with the second sliding plate;

a first tapered bowl movable portion receivable within the gap of the first tapered bowl main portion in a seated position and removable therefrom to a release position;

a second tapered bowl movable portion receivable within the gap of the second tapered bowl main portion in a seated position and removable therefrom to a release position;

a first set of slips sized and shaped for introduction intermediate the first tapered bowl main portion with the first tapered bowl movable portion in the seated position and a first tubular string introduced through the tapered bore of the first tapered bowl main portion to grip and support the first tubular string; and a second set of slips sized and shaped for introduction intermediate the second tapered bowl main portion and the second tapered bowl movable portion in the seated position and a second tubular string introduced through the tapered bore of the second tapered bore main portion to grip and support the second tubular string;

wherein movement of the first tapered bowl movable portion from the seated position releases the first tubular string from the tapered bowl assembly; and wherein movement of the second tapered bowl movable portion from the seated position releases the second tubular string from the tapered bowl assembly.

8. The tapered bowl assembly of claim 7, wherein the base plate comprises high molecular weight polyethylene.

9. The tapered bowl assembly of claim 7, further comprising:

a first retainer assembly having a secured mode to engage and to secure the first tapered bowl movable portion in the secured position within the gap of the tapered bowl main portion and a released mode to release the first tapered bowl movable portion to move from the secured position to the released position; and a second retainer assembly having a secured mode to engage and to secure the second tapered bowl movable portion in the secured position within the gap of the tapered bowl main portion and a released mode to release the first tapered bowl movable portion to move from the secured position to the released position;

wherein the movement of the first retainer assembly from the secured mode to the released mode disables the first set of slips from supporting the first tubular string; and wherein the movement of the second retainer assembly from the secured mode to the released mode disables the second set of slips from supporting the second tubular string.

10. The tapered bowl assembly of claim 7, further comprising:

a first main retainer assembly coupled to the first sliding plate to move the first sliding plate on the base plate and between a closed position and an open position;

a second main retainer assembly coupled to the second sliding plate to move the second sliding plate on the base plate and between a closed position.

* * * * *